United States Patent [19]

Malm

[11] 4,199,802

[45] Apr. 22, 1980

[54] HEADGEAR WITH LIGHT

[76] Inventor: Douglas E. Malm, 2031 W. Palmyra, Apt. C, Orange, Calif. 92668

[21] Appl. No.: 872,931

[22] Filed: Jan. 27, 1978

[51] Int. Cl.[2] ..... F21L 15/14

[52] U.S. Cl. ..... 362/106; 362/105

[58] Field of Search ..... 362/37, 41, 66, 71, 362/105, 106, 107

[56] References Cited

U.S. PATENT DOCUMENTS

| | | | |
|---|---|---|---|
| 319,382 | 6/1885 | Bartram | 362/106 |
| 3,302,018 | 1/1967 | Harding | 362/106 |
| 3,646,339 | 2/1972 | Yssel | 362/71 |
| 3,665,451 | 5/1972 | Keith | 362/105 |
| 4,090,232 | 5/1978 | Golden | 362/106 |
| 4,092,704 | 5/1978 | Malm | 362/106 |
| 4,118,765 | 10/1978 | Atsuchi | 362/71 |

*Primary Examiner*—Stephen C. Bentley
*Assistant Examiner*—Donald P. Walsh
*Attorney, Agent, or Firm*—John N. Randolph

[57] ABSTRACT

A headgear, such as a hardhat or fireman's helmet, having a light unit applied thereto, including a light source for illuminating selective areas adjacent the headgear and which includes a current source for energizing the light source. Said current source forms a part of a drive unit which includes a pendulum and a flexible shaft actuated by the pendulum for changing the direction of the light beam emitted from the light source in response to movements of the head of the wearer of the headgear, for directing the light rays from the light source either in a forward or downward direction.

7 Claims, 8 Drawing Figures

HEADGEAR WITH LIGHT

BACKGROUND OF THE INVENTION

Applicant's prior application Ser. No. 831,244, filed Sept. 7, 1977 discloses an electrically driven means for changing the position of a reflector for varying the direction in which light rays from a light source mounted on a headgear will be directed, in response to movement of the head of the wearer of the headgear, from a normal upright position to a downwardly tilted position, or conversely.

SUMMARY

It is a primary object of the present invention to provide a light source associated with and mounted on a headgear and wherein a pendulum action is utilized for oscillating the light source in response to a tilting movement of the headgear with the head of the wearer.

More particularly, it is an object of the invention to provide a pendulum, which includes a self contained electric current source employed as a weight for the pendulum, and a drive means including a flexible shaft responsive to movement of the headgear relative to the pendulum for imparting oscillating movement to the light source.

A further object of the invention is to provide a light unit which is light in weight and has a low center of gravity which, when applied to the headgear item, can be worn with a minimum of discomfort or inconvenience.

Various other objects and advantages of the invention will hereinafter become more fully apparent from the following description of the drawings, illustrating a presently preferred embodiment thereof, and wherein:

DESCRIPTION OF THE PREFERRED EMBODIMENT

Figure 1:
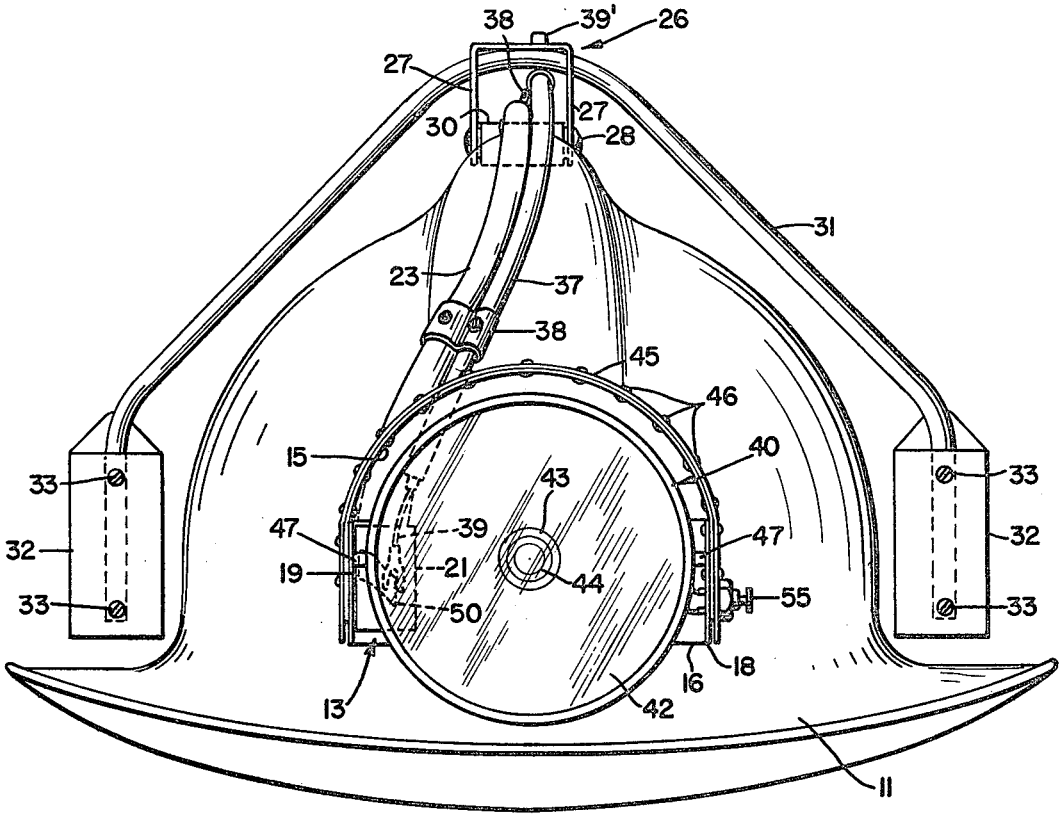
FIG. 1 is a front elevational view of the invention.

Referring more specifically to the drawings, the headgear with light in its entirety is designated generally 10 and comprises a headgear 11, herein illustrated as a fireman's helmet, and an electric light unit designated generally 12.

The unit 12 includes a supporting frame 13 comprising a substantially U-shaped member 14 and an arch member 15. An intermediate portion 16 of the member 14 is bowed inwardly to conformably fit across the front part of the helmet 11 and is secured thereto by fastenings 17 which preferably engage through openings of the helmet, not shown, normally utilized for mounting a helmet insignia. The frame member 14 includes similar forwardly extending, substantially parallel legs 18 and 19. End portions of the arch-shaped member 15 are secured by fastenings 20 to forward ends of the legs 18 and 19 for positioning the member 15 above and between said forward ends of the legs 18 and 19.

Figure 2:
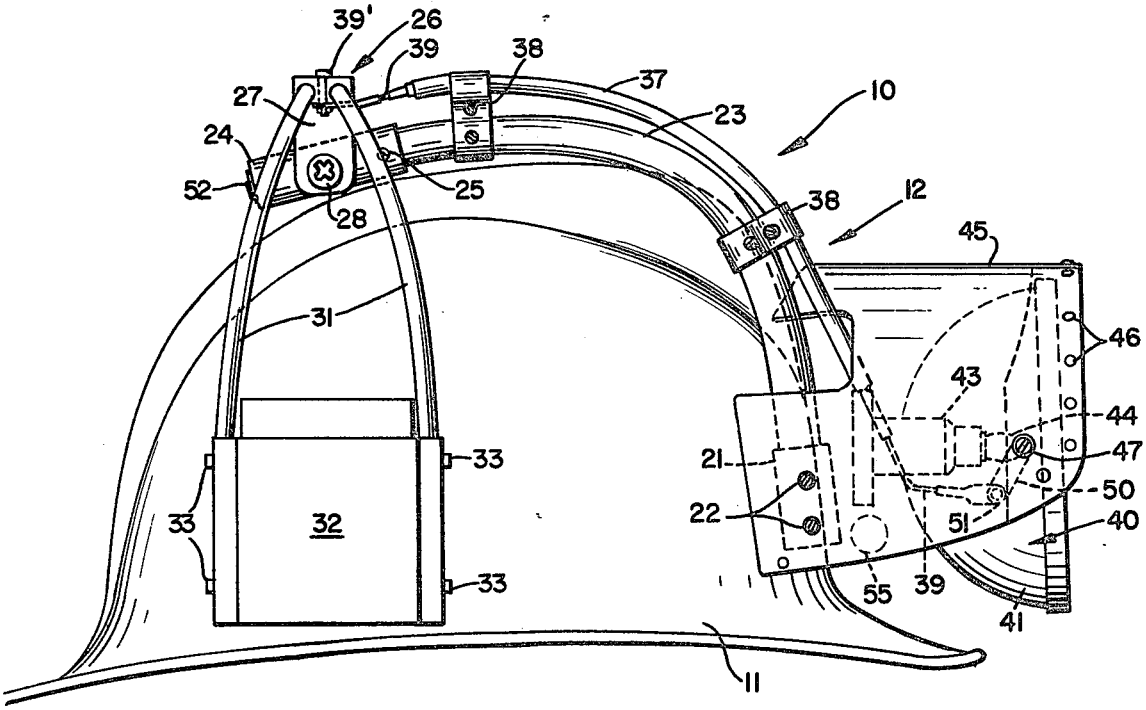
FIG. 2 is a side elevational view thereof.

A sleeve 21 is secured to the inner side of the leg 19, adjacent the part 16, by screw fastenings 22 which additionally function to anchor the lower forward end of a rigid tube 23 immovably in the sleeve 21, to thus secure said tube inmovably to the frame 13. Tube 23 extends upwardly and rearwardly from the sleeve 21 over the top part of the helmet 11 and to a point rearwardly of its transverse center, as seen in FIG. 2. As seen in this Figure, a rear portion of the tube 23 is inclined downwardly and extends into the forward end of a sleeve 24 to which it is secured by at least one fastening 25. An arch-shaped member or yoke 26 has depending legs 27 which straddle the sleeve 24, behind the tube 23. An axle 28 together with a surrounding bushing 29 extends through the sleeve 24 and through the legs 27 for swingably mounting said yoke 26 on the sleeve 24. Spacers 30 straddle the sleeve 24 and are supported by the axle 28 which extends therethrough, for centering the yoke relative to the sleeve 24 and tube 23. Parts 23 and 24 form connecting means between the frame 13 and yoke 26.

Generally arch-shaped rigid tubes 31 have adjacently disposed intermediate portions extending through upper portions of the legs 27 and more remotely disposed terminal portions which straddle battery pack 32 and which are secured thereto by fastenings 33, for mounting a battery pack on each side of the helmet 11, spaced therefrom and adjacent the lowermost part of the helmet, as best seen in FIGS. 1 and 2.

Conductor wires 34 lead from batteries 35, contained in the battery packs 32, through one of the tubes 31 into and from the yoke member 26 then into the sleeve 24 through an opening 36. The conductor wires 34 lead through the tube 23 into the frame 13.

A substantially rigid tube 37 is supported on the tube 23 by clamps 38 and has one end extending into the frame 13 and an opposite end terminating adjacent the yoke 26. A flexible cable 39, constituting a push-pull rod or cable connecting means, extends slidably through the guide tube 37 and to beyond the ends thereof. One end of the cable 39 is attached to the yoke 26 by a fastening 39' which extends down from the top of said yoke. The other end of the cable 39 terminates in the frame 13.

Figure 3:
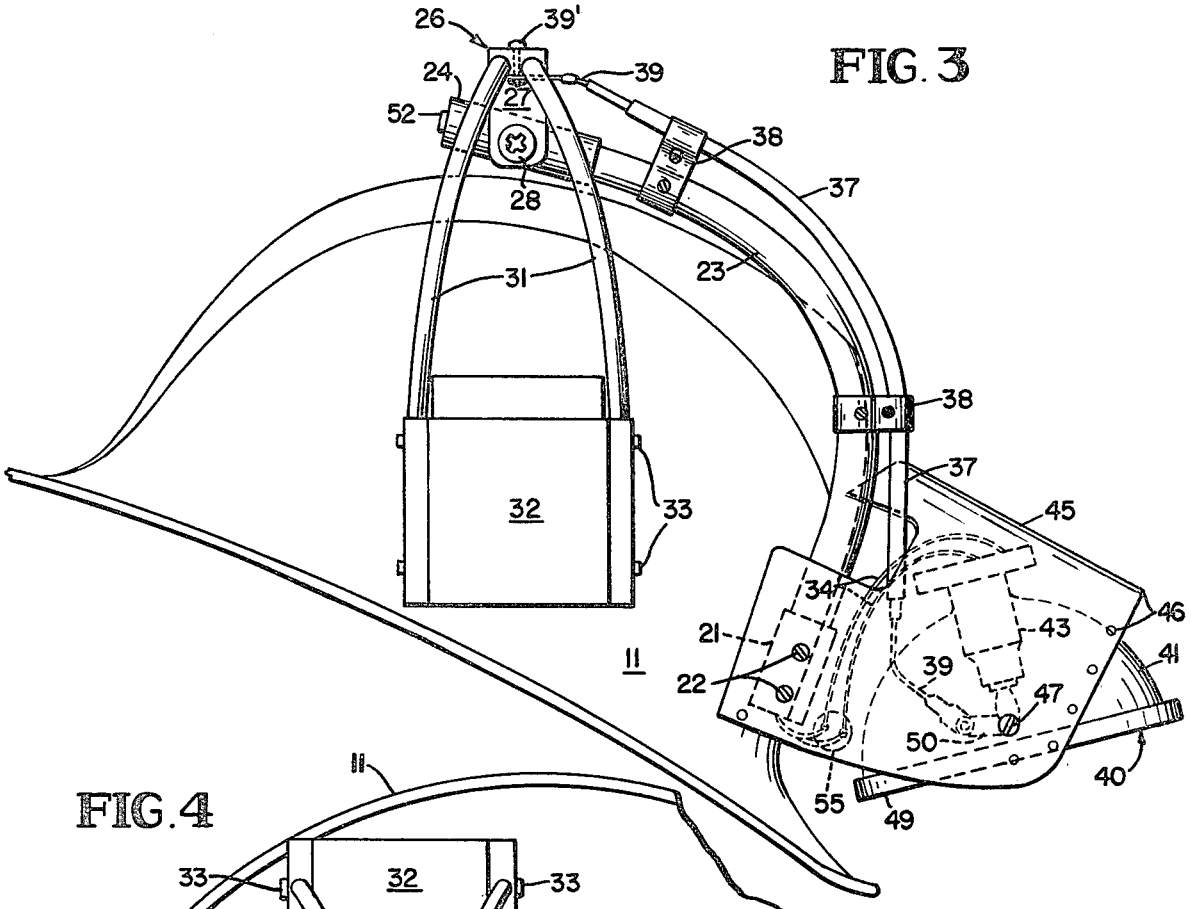
FIG. 3 is a side elevational view, similar to FIG. 2, but showing the headgear tilted down to cause the light source to be tilted down relative to the headgear.
Figure 4:
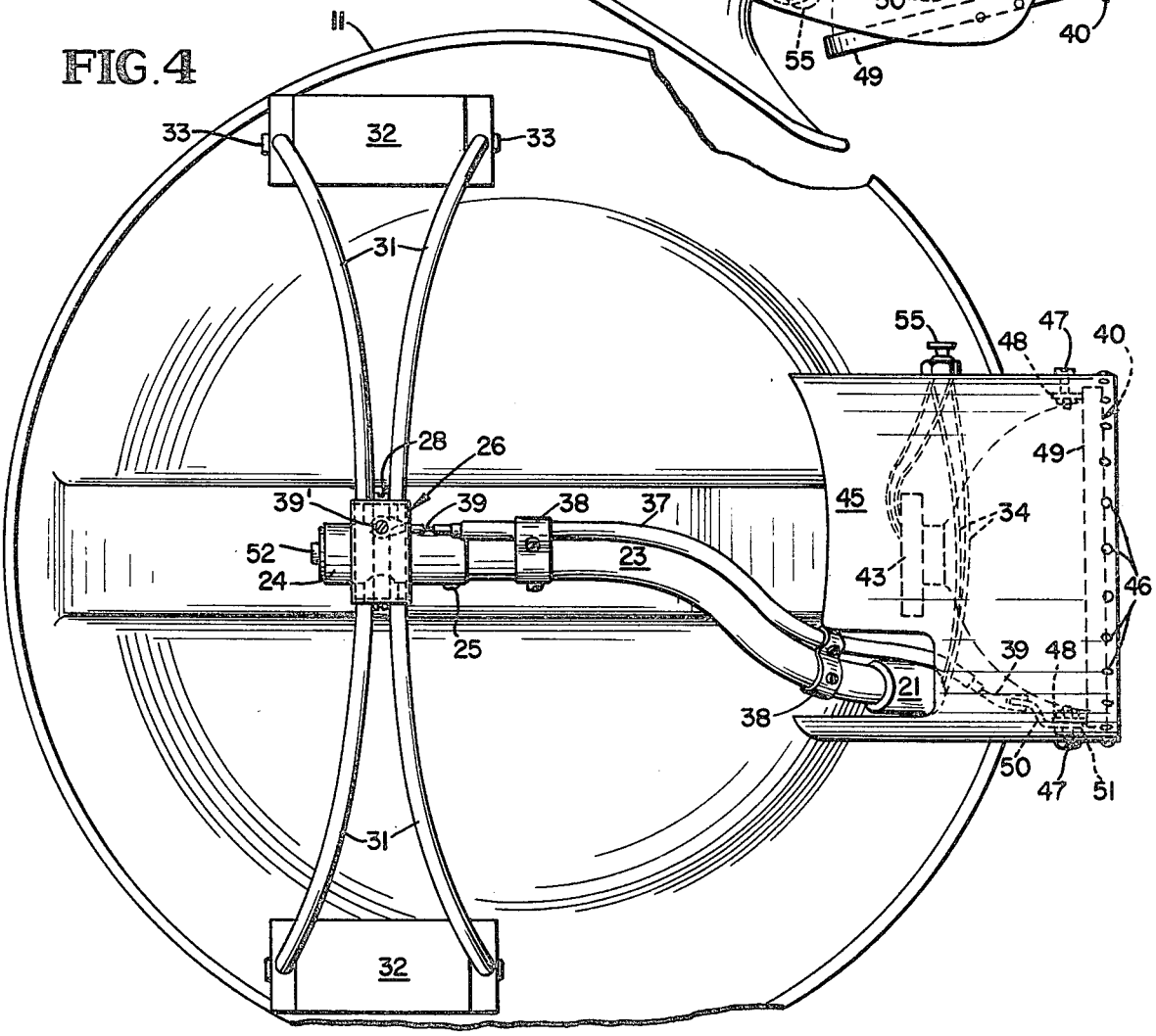
FIG. 4 is a fragmentary top plan view thereof.
Figure 5:
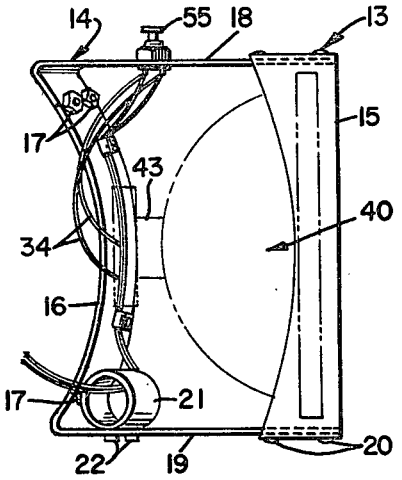
FIG. 5 is a fragmentary top plan view of a portion of the light attachment.
Figure 6:
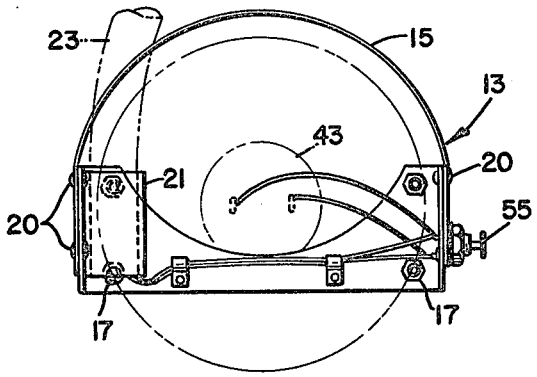
FIG. 6 is a front elevational view of the parts seen in FIG. 5.

A conventional light source 40, consisting of a parabolic reflector 41 having an open front closed by a lens 42 and containing a lamp socket 43 in which is mounted a light bulb 44, is contained partially within the frame 13. A shroud 45 is disposed over the frame 13 and is secured thereto by fastenings 46. Trunnions 47 are journaled in the legs 18 and 19 and in the shroud 45 and extend inwardly from said legs through lugs 48 which extend rearwardly from the lens rim 49 and which are disposed diametrically opposite to one another. A lever 50 is clamped at one end thereof by a nut 51 to one lug 48 and has its opposite end pivotally connected to the other end of the cable 39, which is disposed in the frame 13, as best seen in FIGS. 2 and 3.

As best seen in FIGS. 3 to 7, the conductor wires 34 which extend from the tube 23 into the frame 13 are connected to the lamp socket 43. A conventional push-button switch 55 is mounted in the leg 18 and interposed in the electric circuit, between the batteries 35 and light bulb 44, for energizing and de-energizing said light source.

Figure 8:
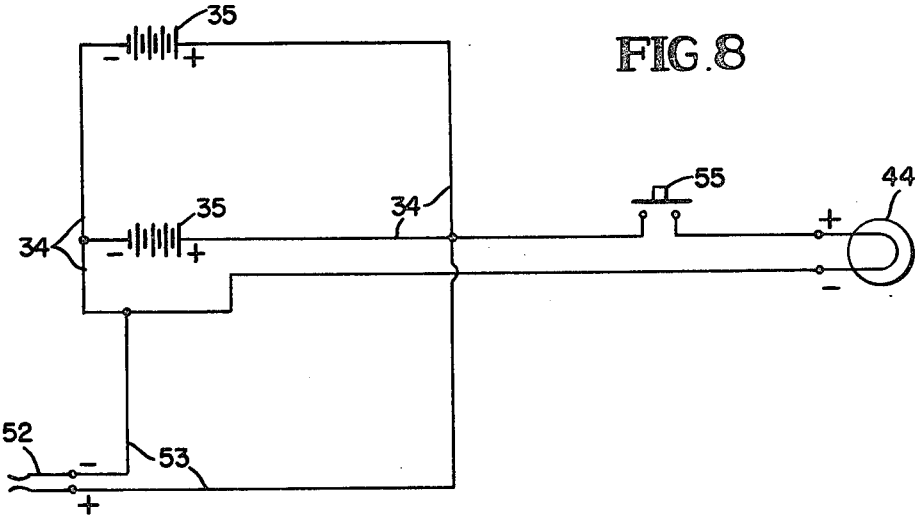
FIG. 8 is a diagramatic view of the electric circuit.

With the head of the wearer of the helmet 11 in a normal upright position, as seen in FIGS. 1 and 2, assuming that the electric circuit of FIG. 8 has been closed by manipulation of the switch 51, light rays from the light source will be directed in a forward direction since the lens 42 is disposed in substantially a vertical plane. The light source 40 is retained in this position of FIGS. 1 and 2 due to the fact that the pendulum 26,31,32 retains the cable 39 in its position of FIG. 2 and said cable, in turn, through the lever 50 retains the light source 40 with its lens covered open front substantially perpendicular. If the head of the wearer of the helmet 11 is tilted downwardly to its position of FIG. 3, the pendulum 26,31,32 will swing relative to the sleeve 24 about its pivot 28 to retain its perpendicular position, thereby exerting a pull on the end of the cable 39 connected to the yoke 26. This pull is transmitted to the lever 50 which is turned clockwise, as seen in FIG. 2, to its position of FIG. 3, for swinging the light source 40 in the same direction, so that said light source assumes a position facing downwardly at an incline relative to the frame 13 and helmet 11, for directing the light rays therefrom downwardly and forwardly, toward the hands or feet of the user. It will also be apparent that a partial movement of the head wearing the helmet 11 between its positions of FIGS. 2 and 3 will cause the light source 40 to be swung relative to the frame 13 and helmet 11, part way between the positions of said light source as seen in FIGS. 2 and 3. It will thus be apparent that a simple mechanical means has been provided whereby tilting movements of the head of the wearer of the helmet 11 will produce a similar tilting movement of the light source 40.

Figure 7:
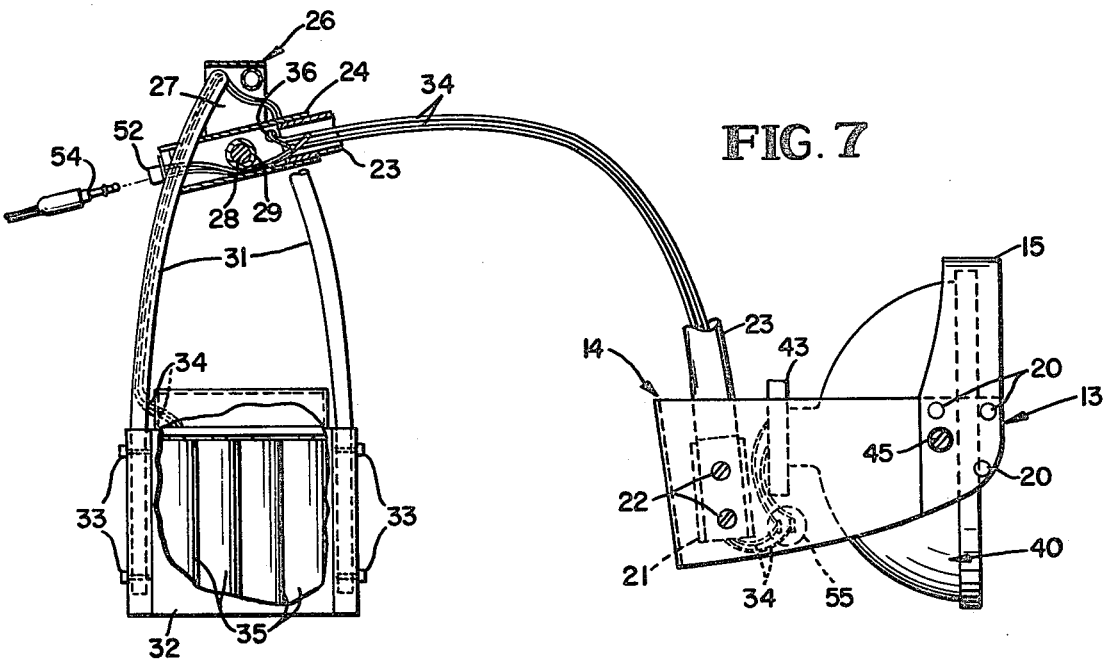
FIG. 7 is a fragmentary side elevational view partly in section of certain of the parts of the light attachment.

A recharging jack 52 is mounted in the rear end of the sleeve 24 and is connected by wiring 53 to the conductor wires 34 so that a recharging plug 54, FIG. 7, can be inserted in the socket 52 for recharging the batteries 35.

Various modifications and changes are contemplated and may be resorted to, without departing from the function or scope of the invention.

I claim as my invention:

1. A headgear with an electric light source comprising a helmet, a substantially rigid frame secured to the front of the helmet and extending forwardly therefrom, means mounting said light source for up and down swinging movement in the frame, rigid connecting means secured to and extending from the frame, a pendulum having an intermediate top portion pivotally supported by said connecting means above the helmet and rearwardly of the frame and including weighted bottom portions straddling bottom parts of the helmet, and a cable control means connecting said top portion of the pendulum to the light source whereby an up and down tilting movement of the front part of the helmet will impart oscillating movement to the pendulum and from the pendulum to the light source, relative to the frame, and in the same direction.

2. A headgear with light as in claim 1, said bottom portions of the pendulum each constituting a battery pack, and electrical conductors connecting batteries of said battery packs to said light source.

3. A headgear with light as in claim 2, said pendulum including tubular members supporting the battery packs and forming conduits for said electrical conductors, and said connecting means comprising a rigid tube providing an additional conduit for the electrical conductors between the pendulum and light source.

4. A headgear with light as in claim 8, the pivot of said pendulum being located near the rear of the helmet and remote from said frame.

5. A headgear with light as in claim 1, said cable control means connecting the top portion of the pendulum to the light source comprising a cable having one end connected to the pendulum and a lever having one end secured to the light source and an opposite end pivotally connected to the other end of said cable, and a rigid guide tube supported by said connecting means and in which said cable is reciprocably mounted.

6. A headgear with light as in claim 1, said top portion of the pendulum comprising an arch-shaped member having depending legs straddling a part of said connecting means, and means pivotally connecting said legs to said part of the connecting means.

7. A headgear with light as in claim 1, and a shroud secured to the frame and disposed over the light source, said shroud having an open front and an open bottom for exposing the open front of the light source.

* * * * *